US005581898A

United States Patent [19]

Thummel

[11] Patent Number: 5,581,898

[45] Date of Patent: Dec. 10, 1996

[54] MODULAR SIGHTING LASER FOR A FIREARM

[75] Inventor: Heinz Thummel, Salinas, Calif.

[73] Assignee: Laser Devices, Inc., Monterey, Calif.

[21] Appl. No.: 100,101

[22] Filed: Jul. 30, 1993

[51] Int. Cl.[6] ..... F41G 1/32

[52] U.S. Cl. ..... 33/241; 33/261; 42/103

[58] Field of Search ..... 33/241, 233, 261, 33/DIG. 21; 42/100, 103; 362/110, 113

[56] References Cited

U.S. PATENT DOCUMENTS

| | | | |
|---|---|---|---|
| 867,552 | 10/1907 | Bradford et al. . | |
| 1,262,270 | 4/1918 | Schmidt | 362/110 |
| 2,075,467 | 3/1937 | Quesada . | |
| 2,485,280 | 10/1949 | Grace . | |
| 3,227,199 | 1/1966 | Mount . | |
| 3,402,613 | 9/1968 | Neusel et al. . | |
| 3,633,285 | 1/1972 | Sensney . | |
| 3,813,790 | 6/1974 | Kaltmann . | |
| 4,281,993 | 8/1981 | Shaw . | |
| 4,313,272 | 2/1982 | Matthews . | |
| 4,662,806 | 5/1987 | Reed . | |
| 4,777,754 | 10/1988 | Reyalds, Jr. | 42/103 |
| 4,781,351 | 11/1988 | Parapetti . | |
| 4,939,863 | 7/1990 | Alexander et al. | 42/103 |
| 5,033,219 | 7/1991 | Johnson et al. . | |
| 5,179,235 | 1/1993 | Toole | 42/103 |
| 5,237,773 | 8/1993 | Clariose | 42/103 |
| 5,282,594 | 2/1994 | Huang | 33/233 |

FOREIGN PATENT DOCUMENTS

| | | | |
|---|---|---|---|
| 2602037 | 1/1988 | France | 33/241 |

OTHER PUBLICATIONS

"The Taurus/Laser Aim Package", Advertisment, Shooting Times Mar. 1990.

Metcalf, Dick, "Laser Sights: Shedding New Light on the Subject"; Shooting Times, Apr. 1991; pp. 42–46.

*Primary Examiner*—Thomas B. Will
*Attorney, Agent, or Firm*—Poms, Smith, Lande & Rose

[57] ABSTRACT

A compact and rugged sighting laser adapted to be mounted on the trigger guard of a firearm such as a handgun. The sighting laser includes a mounting block having a slot adapted to engage the trigger guard, and a housing configured to engage the mounting block. The mounting block includes a hardened retention pin disposed at one end of the block adjacent the slot, and the housing includes a rearward extending plate with a groove configured to receive this pin. The housing further defines first and second bores generally parallel to one another and oriented toward a forward end of the housing. A laser module is disposed in an ellipsoidally shaped casing that fits within the first housing bore, while a battery for the laser fits within the second bore. Threaded screws disposed at a forward end of the housing at right angles to one another press against one end of the ellipsoidal casing in order to provide orientation of the laser with respect to a target point of the firearm. A pair of activation switches are further disposed on opposing sides of the firearm to permit ambidextrous activation of the laser assembly. The switches may also be provided with extended bars to further facilitate one-fingered activation of the laser assembly.

26 Claims, 3 Drawing Sheets

FIG. 1
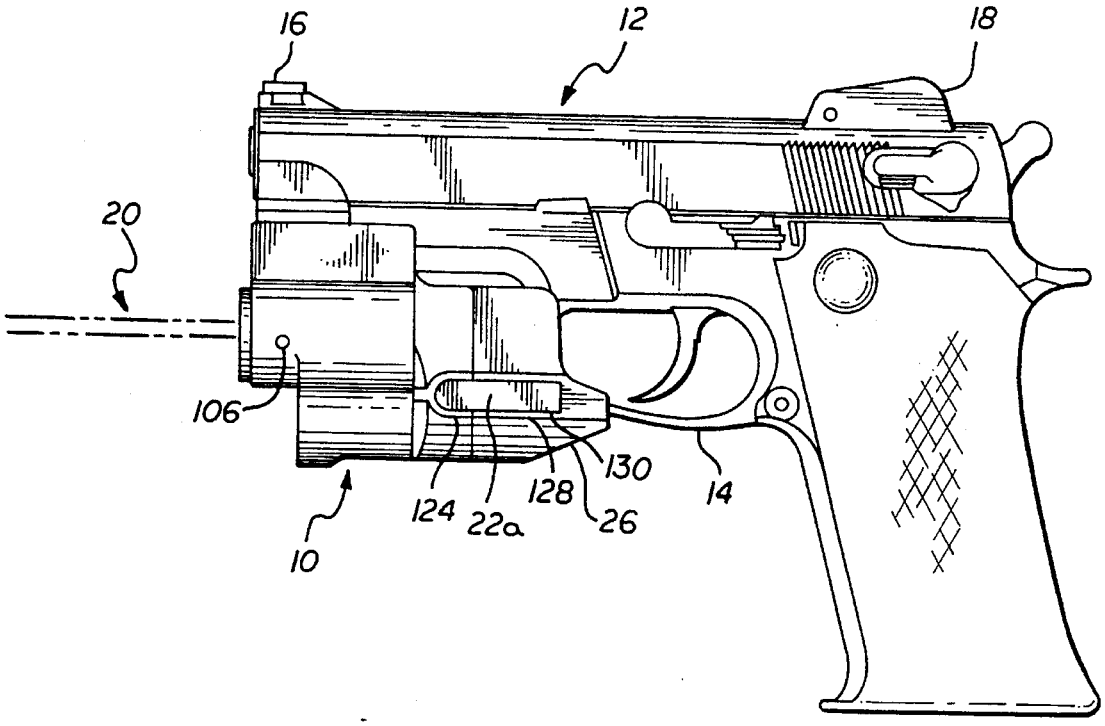
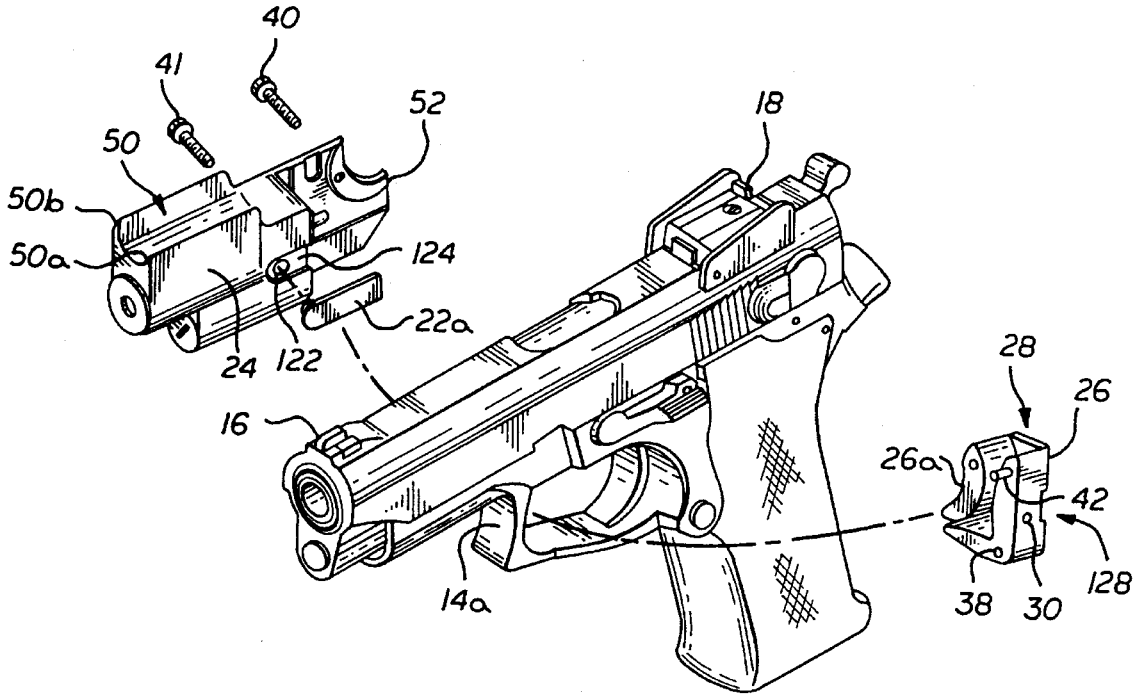
FIG. 2

FIG. 3
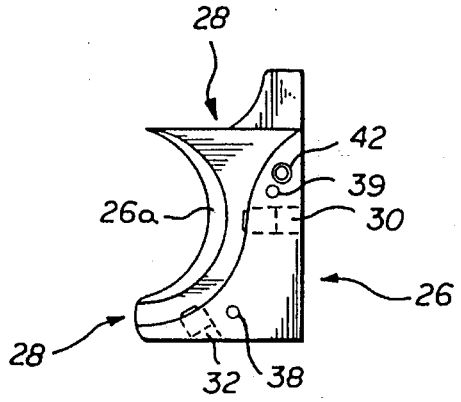
FIG. 4
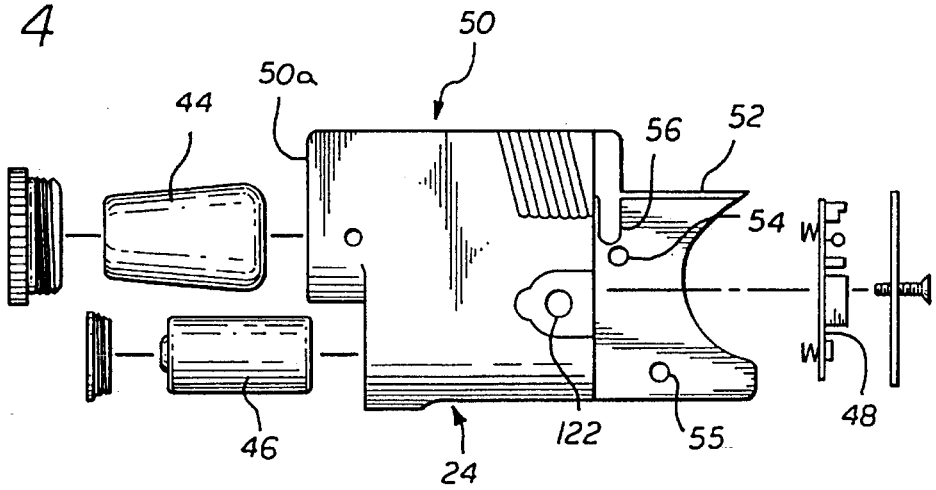
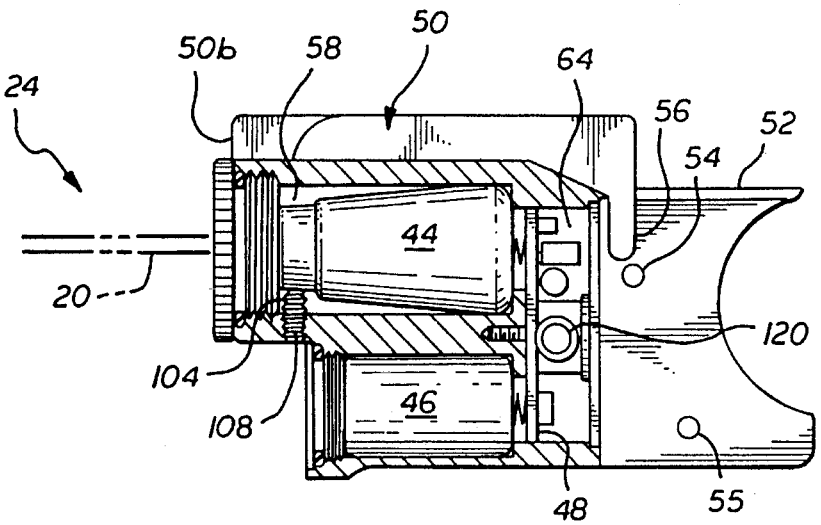
FIG. 5

FIG. 6
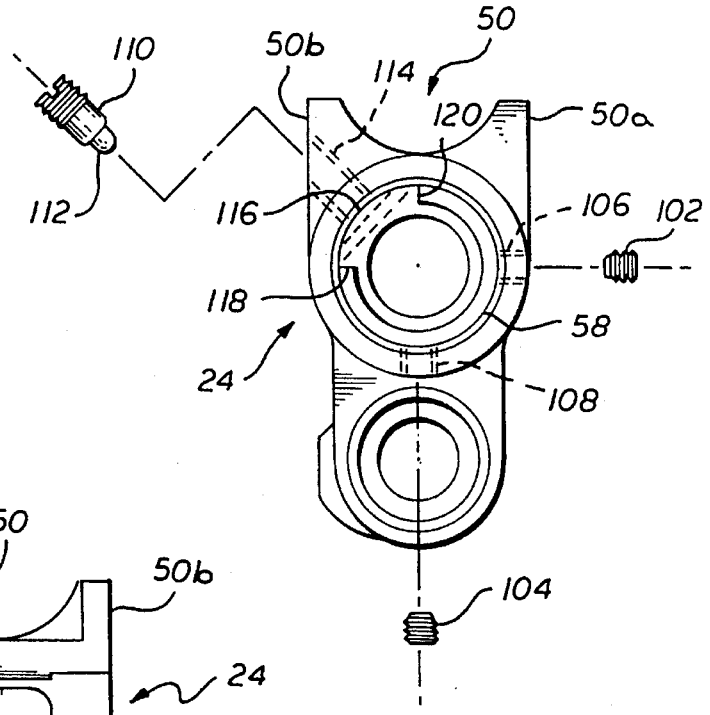
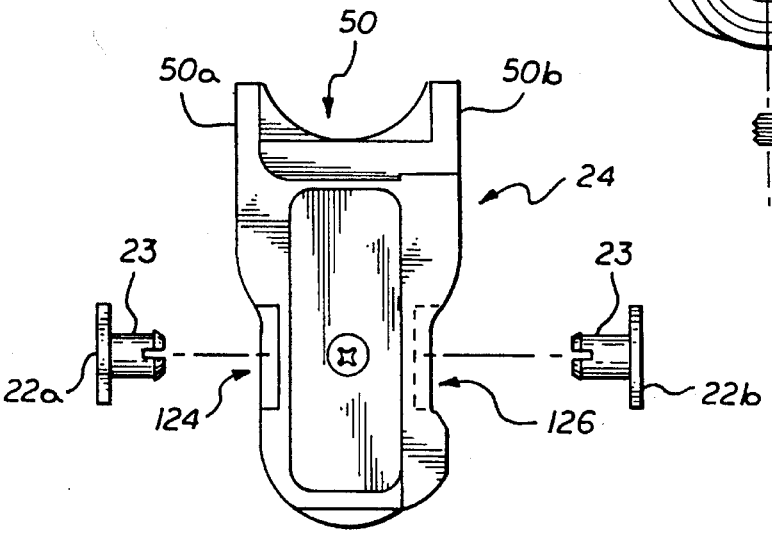
FIG. 7
FIG. 8
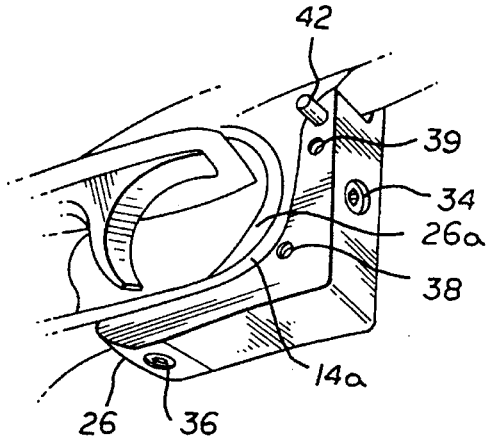
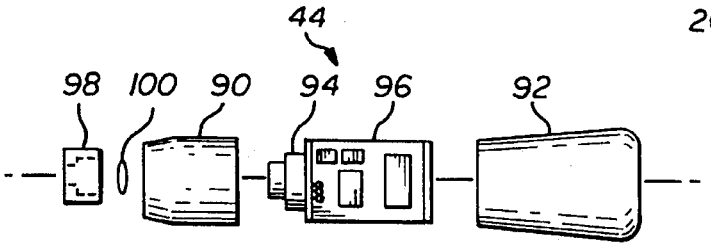
FIG. 9

MODULAR SIGHTING LASER FOR A FIREARM

FIELD OF THE INVENTION

The present invention relates to lasers and, more particularly, to a sighting laser used as an aid in aiming a firearm.

BACKGROUND OF THE INVENTION

The use of a laser beam to aid in the aiming of a firearm has gained considerable popularity in recent years. With the advent of rugged low power gas lasers, as well as solid state diode lasers, it is becoming increasingly possible and practical to attach a small laser to various types of firearms, including handguns. The theory of use is elegantly simple. When the firearm sighting laser is activated, a spot of light is formed on a target, providing an indication of the impact point of a firearm projectile. Even the most inexperienced firearm user can immediately hit an intended target with an extremely high degree of accuracy by simply pointing the firearm so that the laser spot rests on the target.

A firearm sighting laser may generate a spot of light that is either visible or non-visible to the human eye. For example, some types of conventional sighting lasers employ a helium-neon or solid state laser that generates a bright red beam highly visible to the human eye in appropriate lighting conditions. However, in some applications, such as military applications, it is preferred that the laser spot be visible to the firearm user alone. In these applications a laser is selected that cannot be seen by an unaided observer. Infrared wavelength lasers are an example of this specialized form of sighting laser. While perfectly visible to a user equipped with an infrared scope, the laser spot of the sighting laser is otherwise invisible.

Since the firearm projectile typically follows a generally flattened parabolic trajectory, while the laser beam propagates in an essentially straight line, the laser beam normally intersects the impact point of the projectile only within a prescribed range of preselected distances. If the range for use of the firearm is varied substantially, for example by selecting targets at 100 yards instead of 200 yards, the laser beam must be realigned to accurately intersect the changed impact point of the firearm projectile. To accommodate realignment of the laser beam, the light generating elements of the sighting laser are typically disposed within a housing that is rigidly mounted onto the firearm. Some form of alignment optics are then normally employed to orient the laser beam with respect to one or more points along the trajectory of the firearm projectile.

Unfortunately, most of the conventional apparatus employed for attaching a sighting laser to a firearm suffer from a number of drawbacks. The recoil associated with a firearm discharge normally subjects both the firearm and the sighting laser to relatively extreme shock and vibration. Further, even minute displacement of the sighting laser housing with respect to the firearm will cause substantial displacement of the laser spot with respect to the impact point of the firearm projectile. To overcome these extreme environmental conditions, conventional sighting laser mounting devices and sighting laser housings are commonly very bulky and still typically subject to misalignment, either with repeated discharge of the firearm or if the firearm is roughly handled. Military and law enforcement personnel, for example, do not always have the luxury of treating their firearms with the degree of gentleness often required by many conventional sighting lasers.

One conventional approach to mounting a sighting laser on a firearm involves the use of attachment devices developed for optical sighting aids, such as low power optical telescopes. These attachment devices, however, often obscure and render unusable the iron sights normally provided on the firearm itself. This circumstance is frequently considered unsatisfactory for many firearm applications, such as low enforcement and military applications. Other conventional sighting laser attachment devices attempt to mount the sighting laser underneath the barrel of the firearm by attaching the sighting laser to the trigger guard of the firearm. Unfortunately most trigger guard engaging arrangements cannot secure the trigger guard firmly enough to avoid rotation of the sighting laser with respect to the firearm after repeated discharge of the firearm in view of the associated recoil. The resultant rotation of the laser again typically misaligns the laser spot with respect to the firearm projectile impact point. Consequently, sighting lasers employing a mounting scheme that involves attachment to a firearm trigger guard typically require frequent realignment.

One successful sighting laser employing an underbarrel engagement of a firearm trigger guard is the model BA-2 sighting laser manufactured by Laser Devices, Inc., a California corporation. The model BA-2 sighting laser employs a clamshell type housing that includes opposing slots in a rearward portion of the laser housing that are configured to engage a substantial portion of the trigger guard. To achieve satisfactory rigidity in the alignment of the model BA-2 sighting laser with respect to the firearm, a substantial portion of the space bounded by the trigger guard, within which the firearm trigger is disposed, may be obscured. In some instances, for example where gloves are worn, this arrangement can interfere with satisfactory access to the firearm trigger. Thus there still exists a need for a compact and rugged firearm sighting laser that can be rigidly attached to a firearm trigger guard. The present invention fulfills this need.

SUMMARY OF THE INVENTION

Broadly, and in general terms, the present invention provides a compact and rugged sighting laser for a variety of firearms, including handguns. The sighting laser of the present invention is designed to be affixed to an underside of a firearm by engaging the trigger guard of a firearm, but occupies very little of the space bounded by the trigger guard, thus allowing substantially complete access to the firearm trigger. The sighting laser of the present invention may be affixed to conventional firearms without requiring extensive modification or alteration to the firearm, and yet is highly resistant in misalignment commonly caused either from recoil or rough handling of the firearm.

In one preferred embodiment, the present invention includes a mounting block having disposed on one side a slot conforming to the curvature of a firearm trigger guard, a laser housing adapted to engage the mounting block, and a laser module configured to fit within a bore in the housing. A second separate bore is also provided in the housing directly underneath the first bore to store a battery for powering the laser module. The mounting block may include a set screw threadingly engaging the mounting block and biasing the trigger guard against one side of the slot in the mounting block. A second set screw may also threadingly engage the mounting block at approximately right angles to the first screw to further bias appropriately configured trigger guards on some types of conventional firearms. A retention pin is preferably mounted near one end of the mounting block adjacent the trigger guard groove, and the sighting laser housing is provided with a rearwardly projecting plate configured with the groove to engage this retaining pin.

Another aspect of the present invention concerns the laser module disposed within said housing. The laser module includes a generally ellipsoidal or pear-shaped casing having a maximum diameter permitting a friction fit within the first bore of the laser housing. Precise alignment of the laser and the casing is achieved with a pair of set screws threadingly engaging the housing at generally right angles, so as to cause a forward end of the laser casing to pivot with respect the rearward pear-shaped end. A biasing element is also disposed between the laser casing and the inside of the housing bore. In one embodiment, this biasing element is a resiliently tipped screw threadingly engaging a forward end of the housing at generally equidistant and obtuse angles to the alignment screws.

Still another aspect of the present invention concerns an ambidextrous switching system for activation of the laser. A pair of press switches are disposed on opposing sides of the housing to accommodate activation of the laser with either a firearm user's free hand or with the hand holding the firearm. In one embodiment, elongated bars extend back from the switches towards the rear of the laser housing to further facilitate laser activation by providing an extended contact area for switch activation.

Other objects and advantages of the present invention will become more apparent during the course of the following detailed description and taken in connection with the accompanying drawings, wherein like numerals are employed to designate like parts. The accompanying drawings, which are incorporated in and constitute a part of the specification, illustrate an embodiment of the invention and, together with the description, serve to explain the principles of the invention.

BRIEF DESCRIPTION OF THE DRAWINGS

FIG. 1 is a side view of one embodiment of the present invention mounted on an illustrative handgun.

FIG. 2 is a perspective assembly view of the sighting laser illustrated in FIG. 1.

FIG. 3 is a side view of a trigger guard mounting block employed in one embodiment of the present invention.

FIG. 4 is a side assembly view of a laser housing of one preferred embodiment of the present invention.

FIG. 5 is a sectional side view of the laser housing illustrated in FIG. 4.

FIG. 6 is a front view of the laser housing of one preferred embodiment of the present invention.

FIG. 7 is a rear view of the laser housing illustrated in FIG. 6.

FIG. 8 is a perspective view of an alternative embodiment of the mounting block of the present invention, engaging an illustrative firearm trigger guard.

FIG. 9 is a side assembly view of a laser module of one embodiment of the present invention.

DETAILED DESCRIPTION OF THE PREFERRED EMBODIMENTS

Reference will now be made in detail to the preferred embodiments of the present invention, one example of which is illustrated in the accompanying drawings. Referring to the figures, and more particularly to FIGS. 1 and 2, there is shown a preferred embodiment of the sighting laser 10 of the present invention mounted on an illustrative firearm 12. The firearm 12 that is illustrated in FIG. 1 is a semi-automatic handgun of the sort frequently employed by military and law enforcement personnel. It should, of course, be understood that the sighting laser 10 of the present invention is in fact adaptable to a wide variety of differing handguns and various other types of firearms.

As shown in FIG. 1, the sighting laser 10 of the present invention forms a compact structure that is mounted on an underside of the firearm 12, engaging a forward portion **14*a* of the firearm trigger guard 14. This mounting arrangement advantageously avoids obstruction of the conventional firearm sighting structure, including forward sight 16 and rearward sight 18 that are integral elements of the firearm 12. In use, the sighting laser 10 generates a beam 20 which provides a visual reference to a firearm user of the point of impact for a projectile discharged from the firearm 12. The visual aid provided by the laser beam 20 may be used either alone, or in combination with a use of the firearm sights 16 and 18. As discussed more fully below, the sighting laser 10 is activated by depressing either of activation bars 22*a* and 22*b* disposed on opposing sides of the sighting laser 10**.

As shown in FIG. 2, the sighting laser 10 includes a main housing structure 24 and a separate mounting block 26 which together combine and engage the firearm trigger guard 14. The mounting block 26 includes a groove or slot 28 configured to conform to the shape of a forward portion **14*a* of the trigger guard 14. The shape of the trigger guard 14 typically varies among different types of firearms. Thus, a mounting block 26 having a slot 28 conforming to the trigger guard of one type of firearm may not be suitable for use with another firearm. Referring to FIG. 3 and FIG. 8, there are shown further embodiments of mounting block 26, each having slightly differently curved slots 28 to accommodate the slightly differing curvature of forward trigger guard portions 14*a* among differing types of firearms. As shown in FIG. 8, the mounting block 26 is also of sufficient width, and the slot 28 is of sufficient depth, to generally accommodate the entirety of the forward portion 14*a* of the trigger guard 14**.

Referring further to FIGS. 3 and 8, it can also be seen that the mounting block 26 preferably further includes a first threaded bore 30 extending from the slot 28 to a forward side of the mounting block 26 and a second, optional, threaded bore 32 extending from the slot 28 to a lower surface of the mounting block 26. The threaded bores 30 and 32 respectively receive set screws 34 and 36 which force the forward portion **14*a* of the trigger guard 14 against a rearward portion 26*a* of the mounting block 26. Preferably, though not necessary, the set screws 34 and 36 are oriented at approximately right angles to one another, as illustrated in FIG. 8. In conforming to the curvature of the trigger guard of some firearms, however, adequate space may not be available in the region bounded by the trigger guard 14 to provide a sufficiency of volume in the mounting block 26 to accommodate a generally perpendicular orientation of the threaded bores 30 and 32 and respective set screws 34 and 36. In such instances, the second threaded bore 32 and associated set screw 36 may be positioned in an orientation forming less than a right angle with the first threaded bore 30 and associated set screw 34, as illustrated in FIG. 3. The inventor has determined, however, that addition of at least a first set screw 34 to force the forward portion 14*a* of the trigger guard 14 against a rearward portion 26*a* of the mounting block substantially enhances the rigidity of coupling between the trigger guard 14 and the mounting block 26. Thus assuring that the sighting laser 10, when mounted on a firearm 12, is highly resistant to rotation or displacement arising from the extreme shock and vibration caused by discharge of the firearm 12**, with its attendant recoil.

As further illustrated in FIGS. 2, 3 and 8, a preferred embodiment of the mounting block 26 is also provided with a pair of threaded bores 38 and 39 opening into the same surface of a mounting block 26 as the slot 28. These threaded bores 38 and 39 are configured to respectively receive bolts 40 and 41 which secure the housing 24 to the mounting block 26. The mounting block 26 further includes a retention pin 42 disposed at an upper end of the mounting block 26, adjacent the slot 28. As discussed more fully below, the housing 24 also includes a rearwardly extending plate having a groove 56 (see FIG. 4) configured to receive the retention pin 42. The inventor has determined that use of the retention pin 42 further substantially enhances a secure mounting of the sighting laser 10 to the firearm 12. With addition of the retention pin 42, there is provided a mounting structure resistant to even those minute displacements which could cause misalignment of the laser beam with an impact point of a firearm projectile.

Referring to FIGS. 2 and 4 through 6, there is shown in further detail various aspects of the housing 24. As illustrated, the housing 24 provides a compact structure for holding a laser module 44, battery supply 46 and associated laser switching circuitry on a printed circuit board 48. The housing 24 further includes an upper surface 50 generally configured to conform to the underside of the firearm 12. This upper surface 50 may preferably include upwardly projecting sides **50*a* and 50*b* configured to engage opposing sides of the firearm 12. This configuration of the upper structure 50 of the housing 24 has been found to further substantially enhance resistance of the housing 24 to lateral displacement with respect to the firearm 12**.

The housing 24 can also be seen to include a rearwardly extending plate 52 for engaging the mounting block 26 and effectively encasing a forward portion **14*a* of a firearm trigger guard 14. The rearward housing plate 52 includes a pair of countersunk apertures 54 and 55 for receipt of the bolts 40 and 41 that engage the mounting block 26. As mentioned above, the rearward housing plate 52 further includes a precision groove 56 for receipt of the retaining pin 42 extending from the mounting block 26. In a preferred embodiment of the present invention both the mounting block 26 and the housing 24 are made of a sturdy lightweight material such as aluminum. The retaining pin 42**, however, is preferably made of a high strength material such as steel.

Another novel aspect of the present invention concerns the laser module 44 that is received within the first housing cavity 58. As shown in FIG. 9, the laser module 44 includes a first casing portion 90 and a second casing portion 92 within which are disposed a solid state laser 94, with associated circuitry mounted on a printed circuit board 96. The forward casing portion 90 receives an end cap 98 to which a collimating lens 100 is attached. This end cap 98 is preferably a tight slip fit into the forward casing portion 90. The lens 100 within the end cap 98 may be simply bonded to the cap 98. Once the laser module 44 is assembled, and the forward casing portion 90 attached to the rearward casing portion 92, the laser beam 20 may be collimated by positioning the end cap 98 into or out of the forward casing portion 92 until desired degree of collimation is achieved and sealing the end cap 98 in place.

As further illustrated in FIGS. 4 and 5, the laser module 44, when assembled, has a general ellipsoidal or pear-shaped configuration. A portion of the laser module 44 having a maximum diameter is located at a rearward end of the second casing portion 92 and dimensioned to provide a tight friction fit with the inner surface of the first housing bore 58. As further illustrated in FIG. 5, a rearward end of the housing bore 58 preferably, thought not necessarily, also has a curved surface conforming to the curvature of the rearward casing portion 92. This structural arrangement accommodates minute pivotal movement of the forward end of the laser module 44 with respect to the rearward laser module so as to provide a precise alignment of the laser beam 20 with respect to an impact point of a firearm projectile that is highly shock and vibration resistant. A precise alignment of the laser module 44 within the housing 24 that is highly resistant to shock, vibration and re-coil is also achieved in the present invention by further employing a pair of set screws 102 and 104 to engage the forward casing portion 90 of the laser module 94.

As best shown in FIG. 6, the set screws 102 and 104 engage complimentarily threaded bores 106 and 108 that are oriented generally perpendicularly to one another. Threading set screw 102 into or out of the threaded housing bore 106 thus provides generally horizontal pivotal movement of the forward end of the laser module 44 with respect to the housing 24. Similarly, threading the set screw 104 into and out of the housing bore 108 affords generally vertical pivotal movement of the forward end of the laser module 44 with respect to the housing 24.

In order to maintain a precise position of the laser module 44 with respect to the set screws 102 and 104, a biasing element is further disposed within the first housing bore 58 adjacent the first casing portion 90 of the laser module 44. This biasing element applies a force on the casing portion 90 which in turn forces the casing portion 90 against each of the set screws 102 and 104. In one preferred embodiment of the present invention, this biasing element is a threaded screw 110 having a resilient tip 112. The screw 110 is disposed in a complimentarily threaded bore 114 extending from an inner surface of the first housing bore 58 to an exterior surface of the housing 24. To achieve precise pivotal motion of the laser module 44 about generally orthogonal planes, the threaded housing bore 114 is oriented at generally equally spaced obtuse angles from a set screw bores 106 and 108. In an alternative embodiment of the present invention, the biasing element is alteratively a strip of resilient metal 116 (shown in outline form) that is disposed in a pair of notches 118 and 120 formed in a forward end of the first housing bore 58.

Still another aspect of the present invention concerns the switching structure use to activate the sighting laser 10. As partially shown in FIG. 5, a pair of activation switches 120 are disposed within the rearward cavity 64 of the housing 24. These switches 120 may be simple press-type switches in which an electrical connection is closed when the switch is pressed a first time, and then opened when the switch is pressed a second time. Of course, others forms of switch structures could be employed, if desired. The activation switches 120 may, for example, alternatively be simple contact type switches, coupled to an appropriate logic circuit that switches to an on state in response to a first input and switches to an off state in response to a second input.

As shown in FIGS. 2 and 7, the switches 120 engage activation bars **22*a* and 22*b* disposed on opposing sides of the housing 24. The activation bars 22*a* and 22*b* include compressible flanged portions 23 that project through apertures 122 formed in opposing sides of the housing 24 to provide contact with the switches 120. In one embodiment of the present invention, grooves 124 and 126 are also formed in the opposing sides of the housing 24 to receive the activation bars 22***a* and 22*b*, along with a groove 128 may similarly be provided in an exterior side of the mounting block 26. Preferably the grooves 124, 126 and 128 are deeper than the thickness of the bars 22*a* and 22*b* so that the bars are recessed within the grooves. This configuration has been found to avoid accidental activation of the sighting laser when the firearm, to which the laser is attached, is placed in a holster. This unintended activation of the sighting laser could cause an inadvertent depletion of the laser power supply which might not be noticed until the laser is drawn from the holster for its intended use.

As further illustrated in FIG. 1, the rearward end of the groove 126 and the housing 24, and the rearward end of groove 128 and the mounting block 26 preferably terminate in apertures 130 configured to receive the rearward ends of the activation bars 22*a* and 22*b*. These apertures are thus oriented in a plane normal to a longitudinal axis of the activation bars 22*a* and 22*b*. When the sighting laser is fully assembled, with the flange portions 23 of bars 22*a* and 22*b* projecting through the apertures 122 of the housing 24 and with the rearward ends of the bars 22*a* and 22*b* inserted into the apertures 130, the bars 22*a* and 22*b* are securely retained within the structure of the housing 24. This configuration has been found to resist dislodging of the activation bars 22*a* and 22*b* even when the sighting laser is subjected to the extreme shock and recoil of large caliber handguns.

Use of the activation bars 22*a* and 22*b* on opposing sides of the housing 24 provides for ambidextrous activation of the sighting laser 10. Thus, a firearm user can employ a free-hand, or alternatively employ the hand holding the firearm 12 to activate the sighting laser 10 simply by pressing on either of the bars 22*a* or 22*b*. Additionally, the extended length of the bars 22*a* and 22*b* provide that the sighting laser 10 may be rapidly activated by pressing on any portion of an increased surface area provided by the extended length of the bars 22*a* and 22*b*. This arrangement thus advantageously provides for rapid activation of the laser without the need of having to hunt for a switch.

There had thus been disclosed a novel and highly useful sighting laser that is compact, rugged and adaptable for use with conventional firearms, yet highly resistant to misalignment. It will, of course, be apparent to those skilled in the are that there is modifications and changes that can be made in the sighting laser of the present invention without departing from the scope or spirit of the invention. Accordingly, the scope of the present invention should not be limited to the particular preferred embodiments discussed above, but should be defined only by the claims set forth below, and legally permissible equivalence thereof.

What is claimed is:

1. A sighting laser for aiming a firearm with a trigger guard, comprising:

a trigger guard mount having a slot formed in one side and configured to receive a forward end of the trigger guard, said trigger guard mount including a first threaded bore communicating with said slot and with a side of said mount;

a housing adapted to engage said trigger guard mount and having a portion of an upper surface generally conforming to an underside portion of the firearm in front of the trigger guard, said housing further defining a first bore oriented toward a forward end of said housing;

a laser assembly disposed within said first bore of the housing; and means for rigidly attaching said trigger guard mount and said housing to said trigger guard, wherein the sighting laser may provide a reference beam for aiming the firearm.

2. The sighting laser of claim 1 wherein said trigger guard mount further includes a pin disposed generally at one end of said mount and projecting out of the side of said mount defining said slot, and wherein said housing defines a corresponding groove configured to receive said pin.

3. The sighting laser of claim 1 wherein the trigger guard mount further defines a second threaded bore communicating with said slot said second threaded bore being oriented at approximately a right angle to said first bore.

4. The sighting laser of claim 1 wherein said housing further defines a second bore generally parallel with said first bore, wherein said second bore is configured to receive a battery for said laser assembly.

5. The sighting laser of claim 1 wherein said laser assembly is disposed in a generally ellipsoidal container having a maximum diameter dimensioned to contact inner surfaces of said first housing bore.

6. The sighting laser of claim 5 wherein said housing further defines a first threaded bore extending from said first housing bore to an exterior surface of the housing, and a second threaded bore, extending from said first housing bore to an external surface of the housing, oriented generally perpendicular to said first threaded housing bore, said sighting laser further comprising biasing means for biasing an end of the laser container generally towards said first and second threaded housing bores.

7. The sighting laser of claim 6 wherein said biasing means is a resilient strip disposed in said first housing bore adjacent said laser container.

8. The sighting laser of claim 7 wherein said housing further defines a pair of notches within said first bore, oriented to position said resilient strip within the first housing bore adjacent the laser container.

9. The sighting laser of claim 6 wherein said housing further defines a third threaded bore spaced generally equidistant from said first and second threaded housing bores, and wherein said biasing means is a screw having a resilient tip and disposed within said third threaded housing bore.

10. The sighting laser of claim 1 further comprising a first activation switch disposed on one side of the housing and a second activation switch disposed on an opposing side of the housing, wherein the sighting laser has ambidextrous activation switches.

11. The sighting laser of claim 10 wherein said first activation switch further includes a first generally rectangular bar extending along one side of the housing and wherein said second activation switch further includes a second generally rectangular bar extending along an opposing side of the housing, wherein pressure against either of said first and second bars activates the sighting laser.

12. The sighting laser of claim 11 wherein said housing further defines a first and second groove on opposing sides of said housing configured to receive said generally rectangular first and second activation bars.

13. A sighting laser for a firearm with a trigger guard, comprising:

a trigger guard mount having a first side defining a groove configured to accommodate a portion of the firearm trigger guard, and including a pin projecting from said first side;

a housing having a portion of a upper surface generally conforming to an underside portion of the firearm in front of the trigger guard, and further including a plate extending behind said housing and defining a groove adapted to receive said trigger guard mount pin, said housing further defining a first bore oriented toward a forward end of said housing; and a laser assembly disposed within said first bore means for rigidly attaching said trigger guard mount and said housing to said trigger guard.

14. The sighting laser of claim 13 wherein the trigger guard mount further defines a first threaded bore communicating with the slot and a second side of said mount.

15. The sighting laser of claim 14 wherein the mount and housing are made of a first light weight metal, including aluminum, and wherein said pin is made of a second harder metal, including steel.

16. The sighting laser of claim 13 wherein said housing further defines a second bore, generally parallel with said first bore, configured to receive a battery for said laser assembly.

17. The sighting laser of claim 13 wherein the laser assembly is disposed within a generally ellipsoidal container having a maximum diameter dimensioned to contact an inner surface of said first housing bore, and wherein said housing further defines a first threaded bore extending from said first housing bore to an exterior surface of the housing and defining a second threaded bore, extending from said first housing bore to an exterior surface of the housing, oriented generally perpendicular to said first threaded bore, said sighting laser further comprising biasing means for urging said ellipsoidal container generally towards said first and second threaded housing bores.

18. The sighting laser of claim 17 wherein said biasing means is a resilient strip disposed in said first housing bore adjacent said laser container.

19. A sighting laser for aiming a firearm with a trigger guard, comprising:

a trigger guard mount having a slot formed in one side and configured to receive a forward end of the trigger guard;

a housing adapted to engage said trigger guard mount and having a portion of an upper surface generally conforming to an underside portion of the firearm in front of the trigger guard, said housing further defining a first bore oriented toward a forward and of said housing;

a generally ellipsoidal container having a maximum diameter dimensioned to contact inner surfaces of said first housing bore;

a laser assembly disposed within said generally ellipsoidal container;

means for rigidly attaching said trigger guard mount and said housing to said trigger guard, wherein the sighting laser may provide a reference beam for aiming the firearm.

20. The sighting laser of claim 19 wherein said trigger guard mount further includes a pin disposed generally at one end of said mount and projecting out of the side of said mount defining said slot, and wherein said housing defines a corresponding groove configured to receive said pin.

21. The sighting laser of claim 19 wherein said trigger guard mount includes a first threaded bore communicating with said slot and with a side of said mount.

22. The sighting laser of claim 21 wherein the trigger guard mount further defines a second threaded bore communicating with said slot, said second threaded bore being oriented at approximately a right angle to said first bore.

23. The sighting laser of claim 19 wherein said housing further defines a second bore generally parallel with said first bore, wherein said second bore is configured to receive a battery for said laser assembly.

24. The sighting laser of claim 23 wherein said housing further defines a first threaded bore extending from said first housing bore to an exterior surface of the housing, and a second threaded bore, extending from said first housing bore to an external surface of the housing, oriented generally perpendicular to said first threaded housing bore, said sighting laser further comprising biasing means for biasing an end of the laser container generally towards said first and second threaded housing bores.

25. The sighting laser of claim 24 wherein said biasing means is a resilient strip disposed in said first housing bore adjacent said laser container.

26. The sighting laser of claim 24 wherein said housing further defines a third threaded bore spaced generally equidistant from said first and second threaded housing bores, and wherein said biasing means is a screw having a resilient tip and disposed within said third threaded housing bore.

* * * * *